United States Patent [19]

Stadden

[11] Patent Number: 4,679,535

[45] Date of Patent: Jul. 14, 1987

[54] DUAL ACTION GENEVA CAM AND ROTARY INTERNAL COMBUSTION ENGINE AND PUMP UTILIZING SAME

[76] Inventor: Richard S. Stadden, P.O. Box 6053, Atascadero, Calif. 93423

[21] Appl. No.: 816,356

[22] Filed: Jan. 6, 1986

[51] Int. Cl.[4] ..... F02B 53/00

[52] U.S. Cl. ..... 123/245; 74/436; 418/36

[58] Field of Search ..... 74/84 R, 436; 123/43 B, 123/241, 245; 418/35, 36, 38

[56] References Cited

U.S. PATENT DOCUMENTS 157,722 12/1874 Paine ..... 74/436

2,737,161 3/1956 Gaskell ..... 418/36

3,645,239 2/1972 Cena ..... 123/245

*Primary Examiner*—Stephen F. Husar

*Attorney, Agent, or Firm*—Flehr, Hohbach, Test, Albritton & Herbert

[57] ABSTRACT

A dual action geneva cam is disclosed which in general is used for combining the alternating rotative motion of two driving members to produce continuous rotation of a driven member. The dual action geneva cam is incorporated into scissor-action rotary internal combustion engines and scissor-action rotary fluid pumps to provide smooth acceleration, deceleration and locking of the alternately moving pistons of such scissor-action devices.

13 Claims, 17 Drawing Figures

DUAL ACTION GENEVA CAM AND ROTARY INTERNAL COMBUSTION ENGINE AND PUMP UTILIZING SAME

FIELD OF THE INVENTION

The present invention is directed to rotary internal combustion engines and rotary pumps having alternately approaching and receding piston elements. More particularly, the present invention provides a novel mechanism to control the alternate movement and positioning of cooperating pistons in such rotary engines and pumps.

BACKGROUND OF THE INVENTION

Rotary internal combustion engines of the "rat-race" or "cat-and-mouse" variety are known to the art. See Chinitz, W., "Rotary Engines", *Scientific American*, Vol. 220, No. 2 (1969). A major problem associated with these "scissor-action" type engines lies in the high inertial forces generated as the pistons are alternately accelerated and decelerated to generate four-cycle operation. Some designs involve complex crank and gear designs, e.g., Arnal U.S. Pat. No. 3,500,798, complex pin and slot arrangements, e.g., Bancroft U.S. Pat. No. 2,553,954, a sprag assembly in conjuction with a roller wedging mechanism, e.g., Sinnott U.S. Pat. No. 3,282,258 or a hinged pawl-roller assembly which tracks a rotor positioning profile, e.g., Bartolozzi U.S. Pat. No. 3,227,090. Each of these references is either mechanically complex or results in an abrupt change of piston velocity.

Accordingly, it is an object of the invention herein to provide a rotary device that may be used as a rotary internal combustion engine or a rotary pump which is mechanically simple and which provides for smooth acceleration, deceleration and locking of alternating pistons in a "scissor-action" engine.

SUMMARY OF THE INVENTION

The rotary engine of the present invention comprises a stationary engine block having an inner surface defining the outer portion of an annular chamber and first and second piston rotors in side-by-side slidable relationship to each other and coaxially aligned with an engine block aperture wherein each rotor has an outer surface which together define the inner portion of said annular chamber. Each of the piston rotors has at least two diametrically opposed pistons rigidly attached thereto. The pistons are shaped to conform to a radial section of the annular chamber. Each piston rotor is rigidly attached to separate concentric shafts which pass through the engine block aperture, each of which is rigidly connected by offset drive means to a dual action geneva cam. The dual action geneval cam controls the position and movement of the piston rotors and hence the relationship of the piston pairs with respect to each other. It comprises a driven member rigidly conected to a rotatable drive shaft and at least two driving members each rotatively and rigidly connected by said offset drive means to each piston rotor. Two driving members are positioned in adjacent quadrants about the driven member. The driven member comprises two diametrically opposed pins, two diametrically opposed locking cams and two diametrically opposed relief sections. Each of the driving members comprises four cam-locking surfaces to engage and disengage the locking cams of the driven member and four slots to engage and disengage the driving pins of the driven member.

As will be described in more detail hereinafter, the dual action geneva cam of the present invention in general provides a mechanism whereby the alternating rotative motion of at least two driving members is combined to produce continuous rotation of a driven member. When used in a scissor-action rotary internal combustion engine, the dual action geneva cam provides a mechanism whereby one set of pistons is alternately held stationary while a second set of pistons is allowed to smoothly accelerate and decelerate during four-cycle action. In a fluid pump embodiment the dual action geneva cam allows smooth acceleration and deceleration of the pistons during fluid intake and fluid exhaust cycles. Such action helps to minimize the inertial loads inherent in the alternate motions of the pistons and rotors in both embodiments.

DETAILED DESCRIPTION

Figure 1:
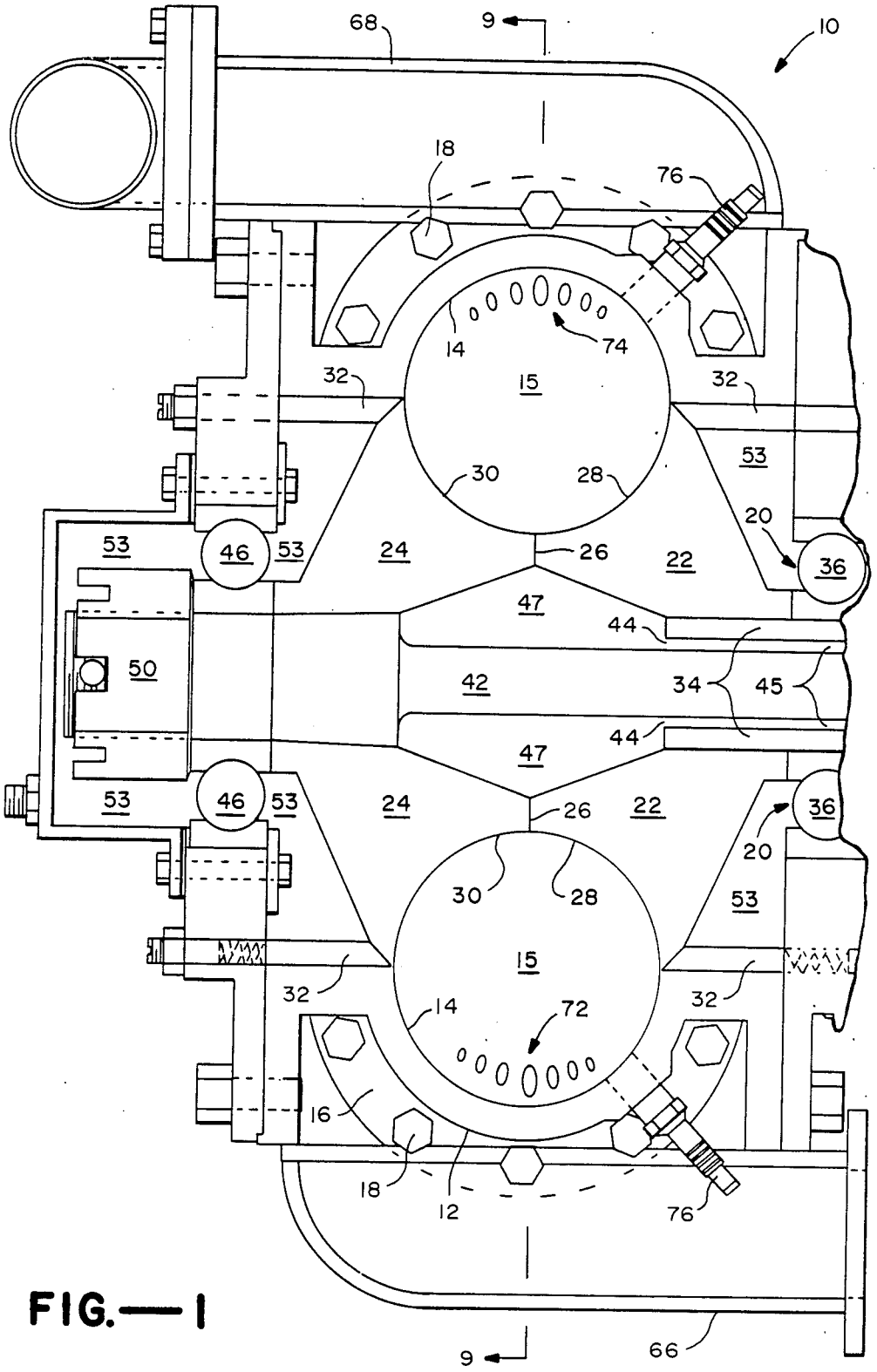
FIGS. 1, 2 and 3 depict a longitudinal partial section of a rotary internal combustion engine of the present invention.
Figure 2:
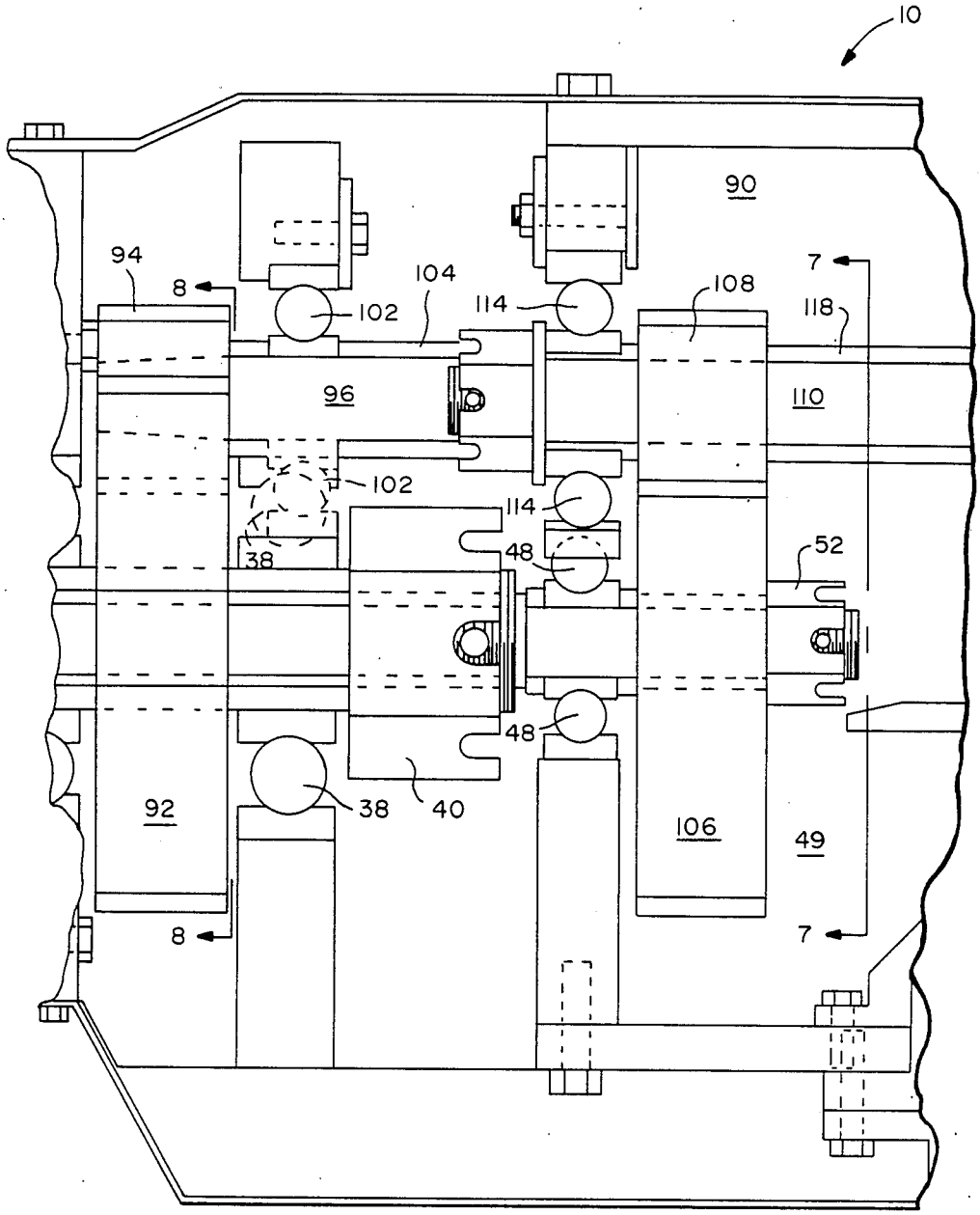
Figure 3:
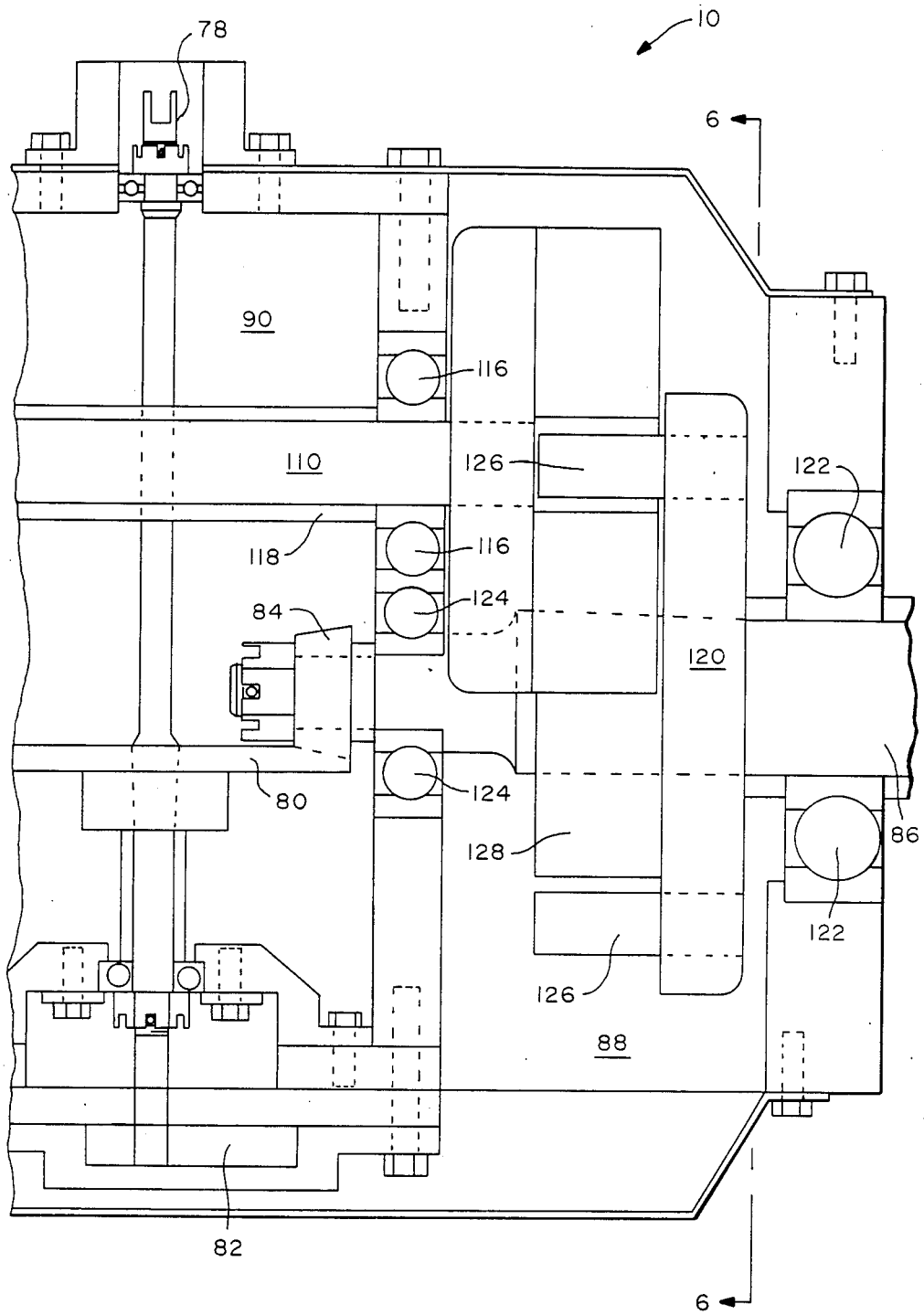

A longitudinal partial section of rotary internal combustion engine 10 is depicted in FIGS. 1, 2 and 3. Stationary engine block 12 has an inner surface 14 which defines the outer surface of a torus cylinder. Engine block 12 is preferably made of cast iron sections which are joined by way of connecting flanges 16 and flange bolts 18. An engine block aperture 20, coaxially disposed with regard to the center of the torus cylinder, is also provided. Front piston rotor 22 and rear piston rotor 24 are positioned side by side and are in slidable relationship to each other through the lubricated surface interface 26. Piston rotors 22 and 24 respectively have outer surfaces 28 and 30 which define the inner portion of torus cylinder 15. The circular spring-loaded adjustable cylinder-piston rotor seals 32 maintain an integral seal between the outer torus surface 14 and the rotor surfaces 30 and 28.

Rotor 22 is rigidly attached to outer cylinder shaft 34 which passes through engine block aperture 20 and which is supported by roller bearings 36 and 38. Rotor 22 and outer cylinder shaft 34 are held in position by outer cylinder shaft nut 40 and retainers for bearings 36 and 38 (not shown).

Rotor 24 is rigidly attached to inner cylinder shaft 42 which passes through aperture 44 of hollow outer cylinder shaft 34. Inner cylinder shaft 42 is free to rotate about roller bearings 46 and 48 and is held in position by said bearings and inner cylinder shaft nuts 50 and 52. Inner cylinder shaft 42 and outer cylinder shaft 34 may be in slidable relationship with each other but in the preferred embodiment the outer diameter of inner cylinder shaft 42 is less than the inner diameter of hollow outer cylinder shaft 34 to provide annular pathway 45. Annular pathway 45 communicates with case 49 and oil return region 47 to return circulated oil from torus cylinder 15 to case 49. Oil pressure is maintained in regions 53. Oil entering torus cylinder 15 is wiped by the piston rings (not shown) from the torus cylinder surface. The oil returns to retaining region 47 through piston oil ports 51 (see FIGS. 4 and 5) and thence through annular pathway 45 to case 49.

Figure 4:
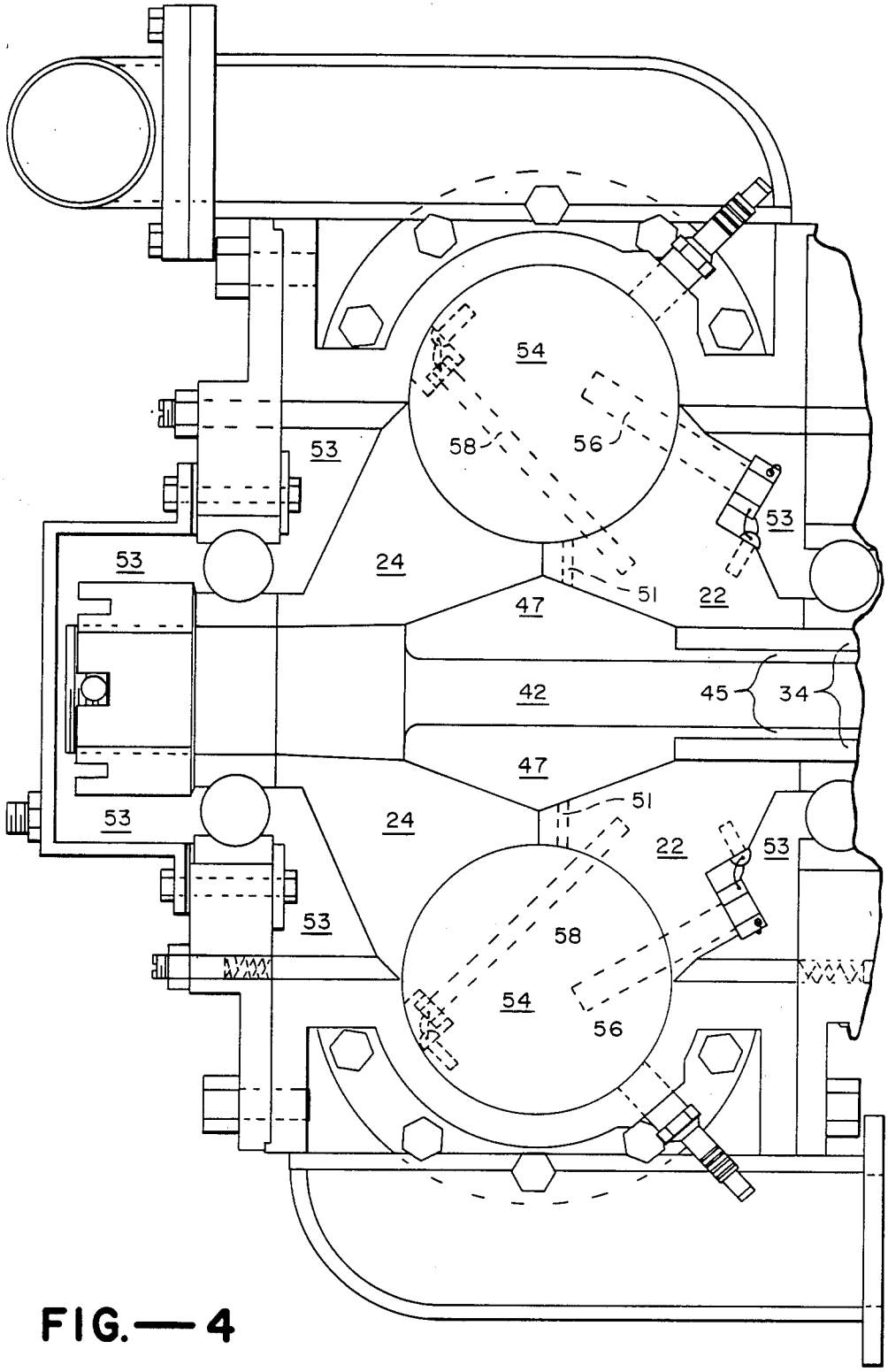
FIG. 4 is a longitudinal section of the engine block of the rotary engine of the invention depicting diametrically opposed pistons attached to the front piston rotor.

As shown in FIG. 4, diametrically opposed pistons 54 are rigidly attached to rotor 22 by way of piston attach bolts 56 and 58. A second set of diametrically opposed pistons (not shown), disposed perpendicular to the pistons shown in FIG. 4, are also rigidly attached to rotor 22 by way of bolts 56 and 58.

Figure 5:
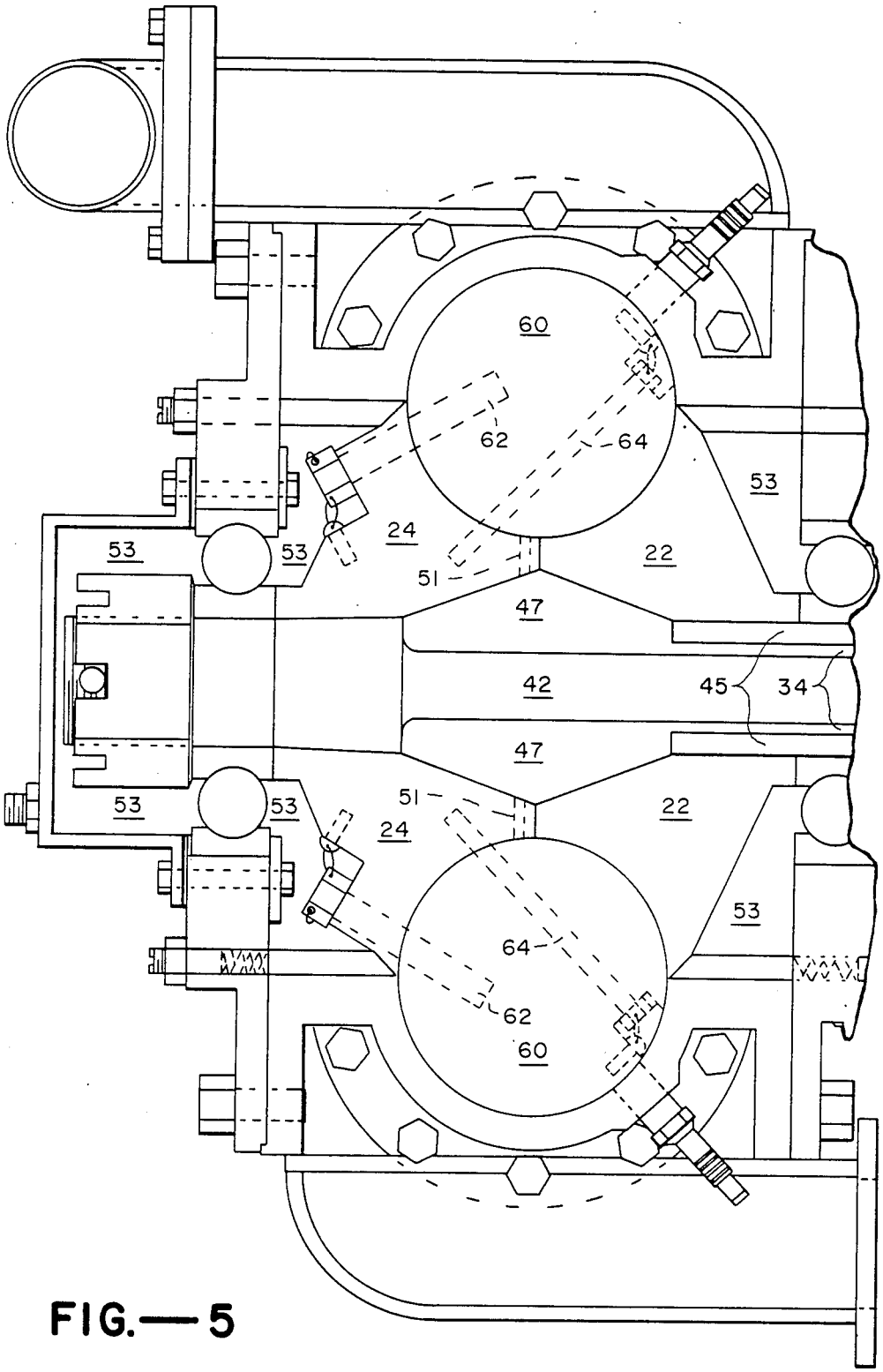
FIG. 5 is a longitudinal section of the same engine block depicting the diametrically opposed pistons attached to the rear piston rotor.

Likewise, diametrically opposed pistons 60 are rigidly attached to rotor 24 in FIG. 5 by way of attachment bolts 62 and 64. As with diametrically opposed piston pairs 54 in FIG. 4, a second set of diametrically opposed pistons 60 is disposed perpendicularly to the pistons depicted in FIG. 5 and are also rigidly attached to rotor 24. All pistons are shaped to conform to a radial section of the torus cylinder and in this embodiment span 27½ degrees of the arc of the torus cylinder.

Figure 9A:
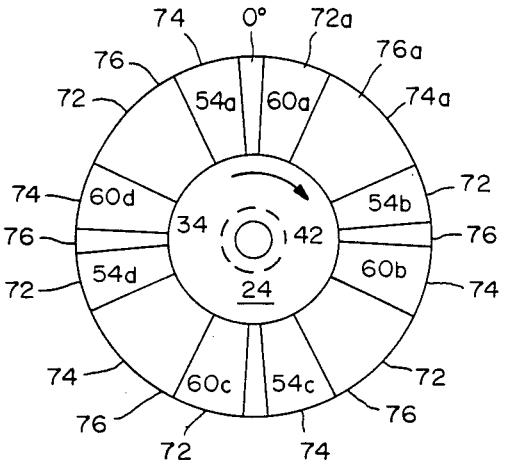
FIGS. 9A through 9E are schematic cross-sections of the torus cylinder of the present invention which depict four-cycle operation of the present invention.
Figure 9B:
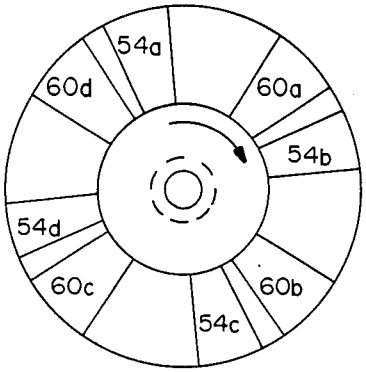

The relationship between pistons 54 and 60 connected respectively to rotors 22 and 24 is depicted in FIG. 9A which is a schematic cross-section of FIG. 1. As can be seen, two sets of diametrically opposed pistons 60 are rigidly attached to rotor 24 and interposed therebetween are two diametrically opposed sets of pistons 54 which are attached to rotor 22 (not shown). As will be described in more detail hereinafter, rotors 22 and 24 alternately rotate through a predetermined arc of torus cylinder 15. Accordingly, diametrically opposed pistons 54 in FIG. 4 depict the longitudinal cross-section of engine block 12 when pistons 54 occupy the position of pistons 60 in FIG. 5.

As shown in FIGS. 1, 2 and 3, rotary engine 10 is equipped with intake manifolds 66 and an exhaust manifolds 68. Each intake manifold 66 is connected through circular manifold 70 to standard carburation means (not shown) known to the art. Each intake manifold 66 communicates with one of the six intake ports 72 which are circumventially spaced about torus cylinder 15. Intake ports 72 are positioned about torus cylinder 15 at 12¼, 72¼, 132¼, 192¼, 252¼ and 312¼ degrees from the centerline defined by the top flange 16 depicted in FIG. 9A. Likewise, exhaust ports 74 are positioned 47¾, 107¾, 167¾, 227¾, 287¾ and 347¾ degrees from top flange 16. Each intake or exhaust port preferably consists of seven linearly aligned holes that communicate with torus cylinder 15. These holes are positioned in a manner which permits the holes to be covered or uncovered by piston 54 or 60 as each piston passes intake or exhaust ports 72 or 74. In this manner the intake and exhaust ports are opened and closed during engine operation. The seven holes comprising each intake and each exhaust port preferably consists of a central hole having a diameter of 19/32 of an inch surrounded by two holes having a diameter of 17/32 of an inch, two holes having a diameter of ½ inch and two holes having a diameter of 7/16 of an inch.

Six conventional sparkplugs are disposed about torus cylinder 15 at positions 30, 90, 150, 210, 270 and 330 degrees from top flange 16 in FIG. 9A. Sparkplugs 76 are connected to standard ignition distributor means (not shown) which is connected to distributor drive 78 in FIG. 3. Distributor drive 78 in turn is connected to distributor gear 80 which drives the ignition distributor and oil pump 82 which provides oil to oil pressure regions 53 and lubrication to other moving parts of the engine. Distributor gear 80 in turn is driven by drive shaft pinion gear 84 which is rigidly attached to drive shaft 86. A flywheel (not shown) is attached to drive shaft 86. Rotative power is transferred to drove shaft 86 by way of the dual action geneva cam 88 in FIGS. 3 and 6 which is connected by offset drive means 90 in FIGS. 2, 3, 7 and 8 to inner cylinder shaft 42 and outer cylinder shaft 34.

Figure 6:
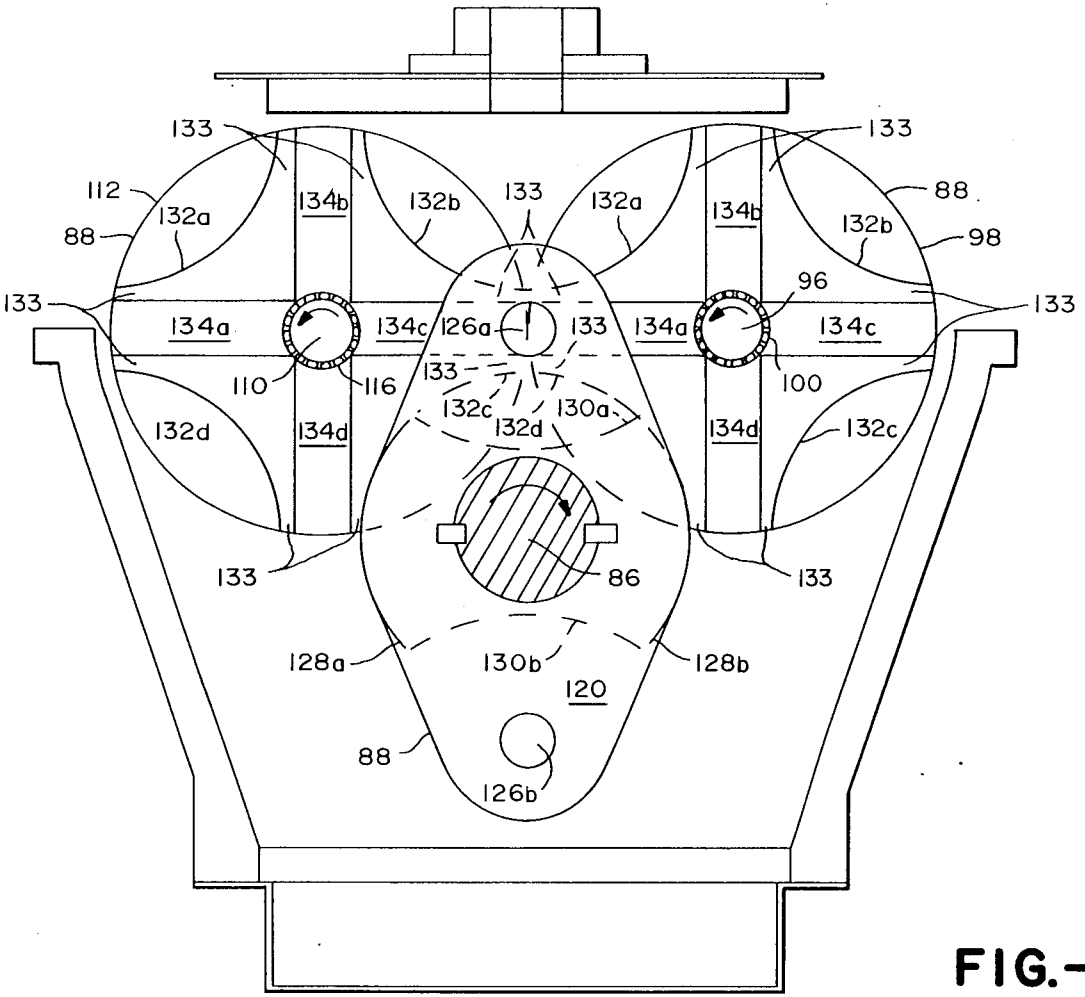
FIG. 6 is a cross-section of the dual action geneva cam of the present invention.
Figure 8:
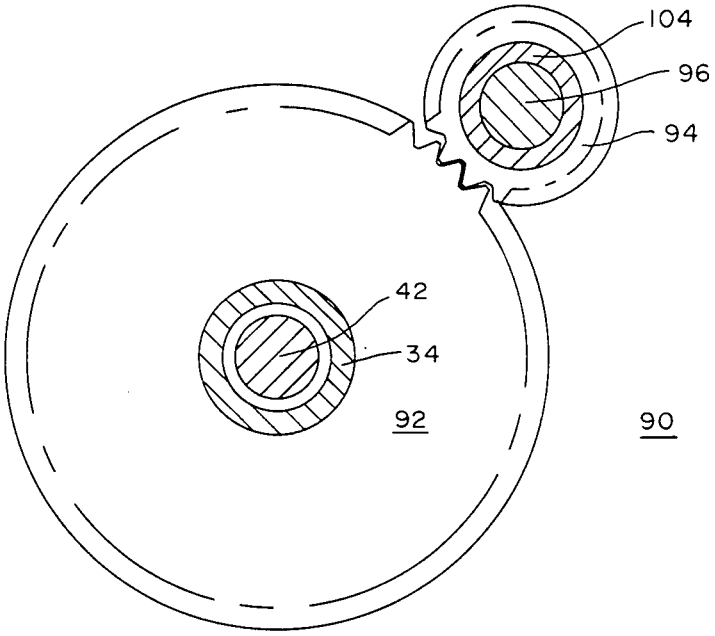

Outer cylinder shaft gear 92 is rigidly connected to outer cylinder shaft 34 and meshes with long geneva shaft pinion gear 94 as depicted in FIGS. 2 and 8. Long geneva shaft pinion gear 94 in turn is connected rigidly to long geneva shaft 96 which is rigidly connected to a first driving member 98 of dual action geneval cam 88 as depicted in FIG. 6. Long geneva shaft 96 and pinion gear 94 are rotatably supported by bearings 100 in FIG. 6 and 102 in FIG. 2. Longitudinal motion of long geneva shaft 96 is prevented by sleeve 104.

Similarly, inner cylinder shaft gear 106 is rigidly attached to inner cylinder shaft 42 and meshes with short geneva shaft pinion gear 108. Pinion gear 108 is rigidly attached to short geneva shaft 110 which is rigidly connected to the second driving member 112 of dual geneva cam 88. Short geneva shaft 110 is rotatably disposed between roller bearing 114 and 116 with longitudinal displacement prevented by sleeve 118.

In this embodiment, the gear ratio between outer cylinder shaft gear 92 and long geneva shaft pinion gear 94 is 3:1. The same gear ratio exists between inner cylinder shaft gear 106 and short geneva shaft pinion gear 108. This gear ratio is chosen to provide a 30 degree movement of each piston rotor 22 or 24 when driving member 98 or 112 is rotated 90 degrees. The 30 degree rotor rotation is dictated by the configuration of intake ports 72, exhaust ports 74 and ignition means 76 disposed about torus cylinder 15 wherein two 30 degree displacements of pistons 60 and 54 are required to achieve four-cycle operation.

Figure 7:
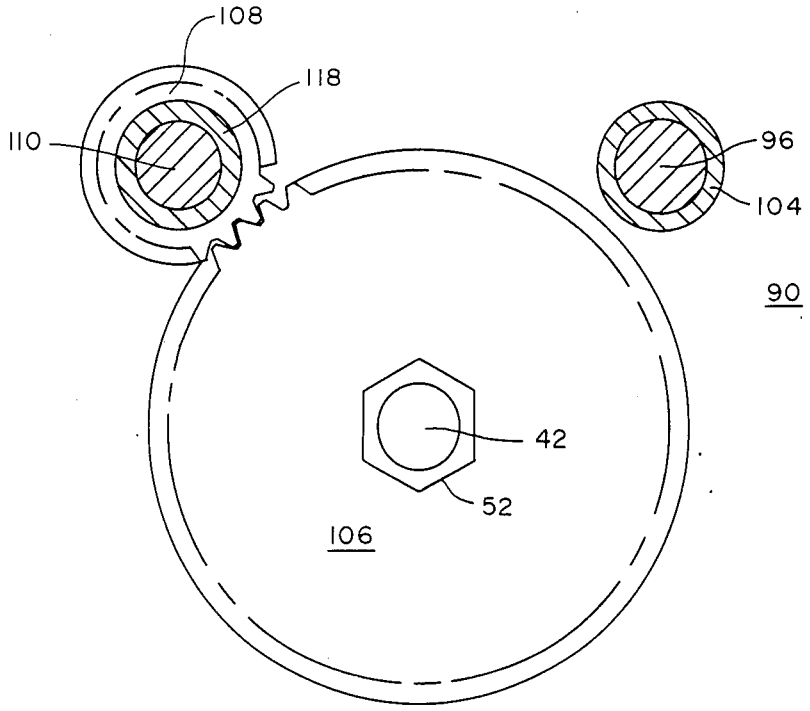
FIGS. 7 and 8 are cross-sections of the offset drive means connecting the piston rotors and dual action geneva cam of the present invention.

Geneva shafts 96 and 110 are positioned in adjacent quadrants about driving member 120 as depicted in FIG. 6. To achieve this relationship geneva shaft pinion gears 108 and 94 are similarly disposed about inner and outer cylinder shaft gears 106 and 92 respectively as depicted in FIGS. 7 and 8. The positioning of driving members 98 and 112 in adjacent quadrants abut driven member 120 is necessary to achieve the dual action of geneva cam 88. Driven member 120 is rigidly attached to drive shaft 86 which is rotatably supported by bearings 122 and 124. Driven member 120 further comprises two diametrically opposed driving pins **126*a* and 126*b*, two locking cams 128*a* and 128*b* which are diametrically opposed and two diametrically opposed relief sections 130*a* and 130*b* as depicted in FIG. 6**.

Driving emmbers 98 and 112 each comprise four cam-locking surfaces **132*a*, 132*b*, 132*c* and 132*d* to engage and disengage the locking cams 128*a* and 128*b* of driven member 120. Driving members 98 and 112 further comprise four slots 134***a*, 134*b*, 134*c*, and 134*d* to engage and disengage driving pins 126*a* and 126*b* of driven member 120.

The operation of dual geneva cam 88 which controls the movement and position of rotors 22 and 24 is easily understood by explaining how drive shaft 86 produces rotor and piston motion. If drive shaft 86 is turning clockwise, as depicted in FIG. 6, at a constant rotation rate the following series of events occurs to control the position and motion of piston rotors 22 and 24 and hence pistons 54 and 60, respectively. As the driving pin 126*a* of driven member 120 engages slot 134*a* of driving member 98, the speed of driving member 98 is zero. This engagement and rotation of driven member 120 induces rotation of driving member 98 in a counterclockwise direction. As driven member 120 continues to rotate, the driving pin 126*a* traverses the length of slot 134*a* on driving member 98. As a consequence, the drive ratio between the driving member 98 and driven member 120 varies depending on the position of driving pin 126*a* in driving member slot 134*a*. Accordingly, the rotation rate of driving member 98 increases to a maximum during the first 45 degrees of rotation and decreases to zero during the last 45 degrees of rotation. As the driving pin 126*a* disengages slot 134*a* of driving member 98, locking cam 128*a* of driven member 120 engages the cam-locking surface 132*a* of driving member 98 to lock the position of driving member 98. Simultaneously, driving pin 126*b* engages slot 134*d* of driving member 112 which, up until this point in time, has been locked in position by locking cam 128*a*. The second driving member 112 thereafter undergoes smooth acceleration and deceleration through 90 degrees of counterclockwise rotation followed by disengagement of driving pin 126*b* from slot 134*d* and engagement of locking cam 128*b* with cam-locking surface 132*d* to hold driving member 112 stationary. The relief sections 130*a* and 130*b* permit the disengagement of locking cams 128*a* and 128*b* from cam-locking surfaces 132 and also provide clearance for the projections 133 of driving members 98 and 112. The movement and positioning of rotors 22 and 24 and pistons 54 and 60 respectively of rotary engine 10 are thereby controlled by dual action geneva cam 88 in FIG. 6 by way of offset drive means 90. When operated as a four-cycle internal combustion engine, dual geneva cam 88 transmits rotative power from piston rotors 22 and 24 to drive shaft 86.

Figure 9C:
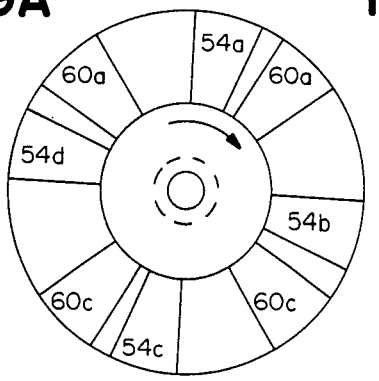
Figure 9D:
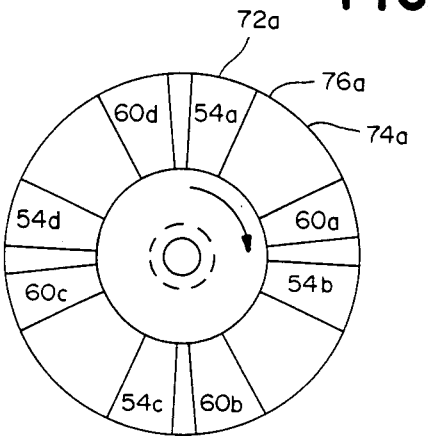
Figure 9E:
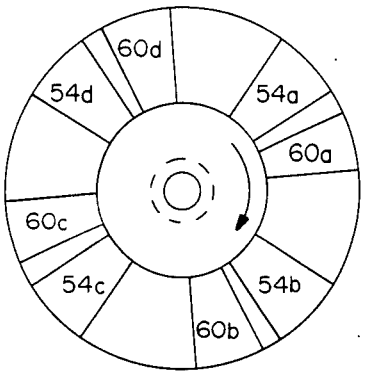

Operation of the disclosed rotary engine is most easily understood by considering the four-cycle action of two adjacent piston. FIGS. 9A through 9E depict schematic cross-sections of torus cylinder 15 wherein pistons 60 and 54 are designated as pistons 60*a* through 60*d* and pistons 54*a* through 54*d*. In FIG. 9A, piston 60*a*, rigidly attached to piston rotor 24, is connected through the short geneva shaft 110 to driving member 112. Piston 60*a* moves clockwise 30 degrees to the position depicted in FIG. 9B as the result of the expansion of an ignited combustible mixture between pistons 54*b* and 60*b* and pistons 54*d* and 60*d*. This movement is made possible by the counterclockwise rotation of driving member 112 through 90 degrees of arc. As piston 60*a* passes intake port 72*a* (depicted in FIG. 9A), a combustible mixture is drawn into the intake chamber defined by the displacement of piston 60*a* relative to piston 54*a*. At this point, driving member 112 is locked by locking cam 128*a* to prevent further motion of pistons 60*a* through *d*. As shown in FIG. 9C, piston 54*a* now moves through 30 degrees of arc in a clockwise direction as a result of the expansion of an ignited combustible mixture between pistons 60*b* and 54*c* and pistons 60*d* and 54*a*. This movement of pistons 54 occurs because driving member 98 is now free to rotate 90 degrees in a counterclockwise direction. During this rotation, driving pin 126*a* engages slot 134*a* of driving member 98 as shown in FIG. 6. A compression chamber is defined by the displacement of piston 54*a* during this part of the cycle. In FIG. 9C pistons 54*a* and 60*a* are separated by approximately 2½ degrees of radial arc defining a combustion chamber in the region of sparkplug 76*a*. Sparkplug 76*a* ignites the compressed combustible mixture contained in the thus defined combustion chamber. However, piston 54*a* is now held stationary by the engagement of locking cam 128*a* with cam-locking surface 132*a* of driving member 98. Since driving member 112 is no longer restrained by locking cam 128*a*, piston 60*a* moves clockwise to the position depicted in FIG. 9D upon a second 90 degree counter-rotation of driving member 112. This displacement of piston 60*a* defines an expansion chamber portion of torus cylinder 15. As piston 60*a* passes exhaust port 74*a* the exhaust gases are free to enter exhaust manifold 68. Piston 60*a* is thereafter held stationary by the interaction of locking cam 128*b* with cam-locking surface 132*a* of driving member 112 while piston 54*a* is allowed to rotate clockwise because of the expansion of ignited combustible mixtures between pistons 60*c* and 54*d* and 60*a* and 54*b*. This displacement of piston 54*a* defines an exhaust chamber portion of torus cylinder 15 and facilitates the removal of exhaust gases through exhaust port 74*a* as depicted in FIG. 9E.

Although four-cycle operation has only been described for two individual pistons through one complete cycle of operation, it should be apparent that four-cycle operation is occurring between other sets of pistons around the torus cylinder. For example, the same events described for pistons 54*a* and 60*a* are simultaneously occurring for pistons 54*c* and 60*c*. In particular, 24 movements of 30 degrees each occur when the eight pistons have traveled a complete 360 degrees through the torus cylinder to produce 48 power strokes.

Figure 10:
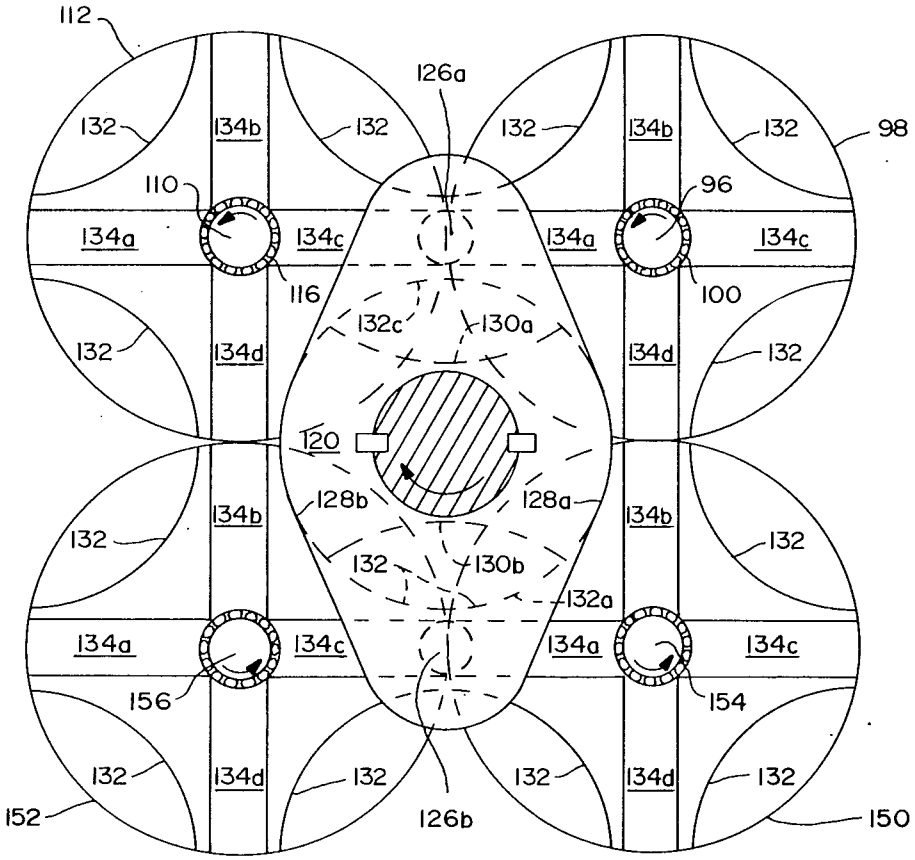
FIG. 10 is an alternate embodiment of the dual action geneva cam of the present invention.

In an alternate embodiment, the dual geneva cam 88 of FIG. 6 may be supplemented by the addition of two additional driving members 150 and 152 as shown in FIG. 10. Driving member 150 is rigidly connected to a second short geneva shaft 154 which is connected by way of a second short geneva shaft pinion gear (not shown) to inner cylinder shaft gear 106. Similarly driving member 152 is rigidly connected to a second long geneva shaft 156 which in turn is rotatably connected through a second long geneval shaft pinion gear (not shown) to outer cylinder shaft gear 92. As shown in FIG. 10, when driven member 120 rotates in a clockwise direction pin 126*a* engages slot 134*a* of driving member 98 while driving pin 126*b* engages slot 134*c* of driving member 152. At the same time, locking cam 128*a* engages cam-locking surface 132*a* of driving member 150 while locking cam 128*b* engages cam-locking surface 132*c* on driving member 112. Accordingly, driving members 98 and 152 concertedly interact with driven member 120 to provide rotative power to drive shaft 86. Similarly, driving members 112 and 150 concertedly interact with driven member 120 to prevent rotation of rotor 22 and the piston attached thereto. As driven member 120 continues its rotation the concertedly interacting driving members alternately permit movement and stationary positioning of rotors 22 and 24 while continuously providing rotative power to drive shaft 86.

The torus cylinder of the present invention is fabricated from cast iron. The intake and exhaust manifolds and main engine case are made of cast aluminum alloy. The pistons may be made from an aluminum alloy but are preferably made of steel. The ball bearings, various shafts, gears and dual action geneva cams are also preferably made of steel.

Each piston is provided with four piston rings. The two nearest the piston faces are the compression rings, and the two other are oil rings. The grooves for the oil rings are provided with piston oil ports 51 so that oil may drain back into the engine case. Laminated piston rings are used as they conform more readily to the torus cylinder bore thereby providing better sealing than solid rings.

Various specifications for this preferred embodiment are as follows:

Torus Cylinder bore diameter: 4.0"
Minimum torus cylinder diameter: 4.5"
Maximum torus cylinder diameter: 12.5"
Area of piston: 12.5664 sq. in.
Piston stroke: 2.2253"
Compression ration: 6.43:1
Displacement: 223.712
Computed Horse Power: 308.225

Figure 11A:
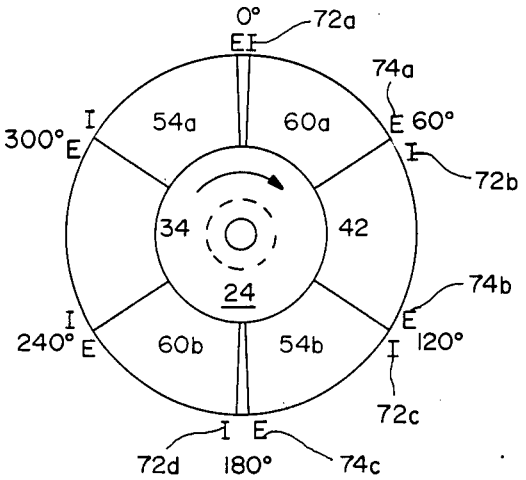
FIGS. 11A through 11C depict operation of the fluid pump embodiment of the present invention.
Figure 11B:
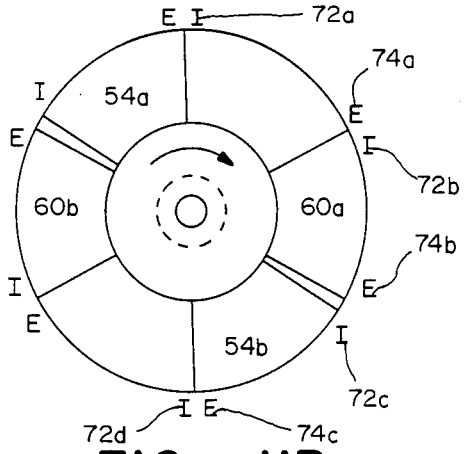
Figure 11C:
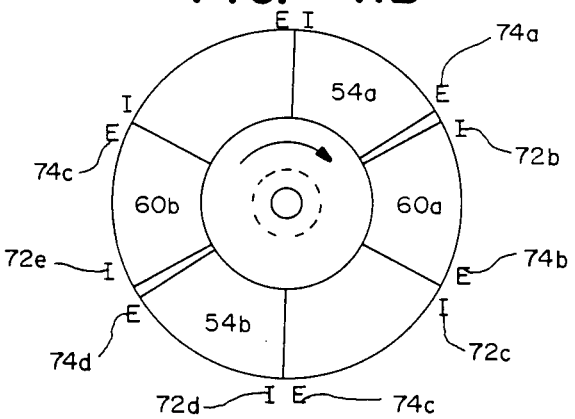

A fluid pump embodiment of the present invention is shown in FIGS. 11A through 11C which depict cross-sections of the torus cylinder 15, similar to those of the rotary engine embodiment, wherein pistons 60 and 54 are designated 60*a* and 60*b* and 54*a* and 54*b*, respectively. The pump embodiment differs from the engine in that no carburetor, ignition distributor, spark plugs or combustion chambers are used. In addition, there are only four pistons each of which span 57½ degrees of the torus cylinder. Outer and inner cylinder shaft gears 92 and 106 and geneva shaft pinion gears 94 and 108 are modified to provide a gear ration of 3:2. The intake and exhaust ports, cylinder shafts and dual action geneva cam are the same as used in the rotary engine embodiment with their movements cooperating as described for the rotary engine.

In FIG. 11A, pistons 60*a* and 60*b*, rigidly attached to piston rotor 24, are connected through short geneva shaft 110 to driving member 112 in FIG. 6. Piston 60*a* moves clockwise 60 degrees to the position depicted in FIG. 11B as the result of drive shaft 86 being driven by an electric motor, or gasoline or diesel engine. This movement is made possible by counter-clockwise rotation of driving member 112 through 90 degrees of arc as a result of engagement of driving pin 126*a* with slot 134*c* of driving member 112. The driving pin 126*a* traverses the length of slot 134*c* as driving member 120 is being turned by drive shaft 86. FIG. 6 depicts the position of dual action geneva cam 88 after this motion.

As pistons 60*a* and 60*b* pass intake ports 72*a* and 72*d* respectively a liquid or a gas is drawn through the individual ports into intake chambers defined between pistons 60*a* and 54*a* and pistons 60*b* and 54*b*. Driving member 112 is then locked by engagement with locking cam 128*a* and cam locking surface 132*c* to prevent further motion of piston 60*a* and 60*b*. At this point, exhaust ports 74*a* and 74*d* are opened to permit the pumping of the fluid through the exhaust ports during the next part of the pumping cycle.

Pistons 54*a* and 54*b* then move through 60 degrees of arc in a clockwise direction to the position shown in FIG. 11C as the result of further rotation of drive shaft 86. This movement of pistons 54*a* and 54*b* occurs because driving member 98 is now free to rotate 90 degrees in a counter-clockwise direction. This is possible because relief section 130*a* has allowed disengagement of locking cam 132*d*. During this rotation, driving pin 126*a* engages slot 134*a* of driving member 98. The displacement of pistons 54*a* and 54*b* define exhaust chambers for this part of the pumping cycle. Upon completion of the pumping cycle, pistons 54*a* and 54*b* are separated respectively from pistons 60*a* and 60*b* by 2½ degrees of radial arc. Exhaust ports 74*a* and 74*d* at this point are closed by pistons 54*a* and 54*b* respectively. A second pumping cycle is thereafter initiated by the movement of pistons 60*a* and 60*b* to draw fluid into the torus cylinder through intake ports 72*b* and 72*e* respectively.

It should be noted that any time there is a piston movement of 60 degrees, liquid or gas is being drawn into two intake ports and is simultaneously being exhausted under pressure through two exhaust ports.

Having described the preferred embodiments of the present invention, it will appear to those ordinarily skilled in the art that various modifications may be made to the disclosed embodiments, and that such modifications are intended to be within the scope of the present invention.

What is claimed is:

1. A dual action geneva cam comprising:

(a) a driven member rigidly connected to a drive shaft, said driven member comprising two diametrically opposed driving pins, two diametrically opposed locking cams and two diametrically opposed relief sections, and (b) at least first and second driving members rotatively disposed in adjacent quadrants about said driven member, each of said driving members comprising four cam-locking surfaces to engage and disengage said locking cams of said driven member and four slots to engage and disengage said driving pins of said driven member whereby said driven member continuously rotates when alternatively said first driving member is held stationary while said second driving member rotates.

2. A rotary fluid pump comprising a dual action geneva cam in combination with a scissor-action rotary pump wherein said dual action geneva cam controls the position and movement of first and second piston rotors in said scissor-action rotary pump and includes:

(a) a driven member rigidly connected to a drive shaft, said driven member comprising diametrically opposed driving pins, diametrically opposed locking cams and diametrically opposed relief sections, and (b) driving members connected by offset drive means to said first and said second piston rotors and disposed about said driven member, each of said driving members comprising cam-locking surfaces to engage and disengage said locking cams of said driven member and slots to engage and disengage said driving pins of said driven member whereby alternatively said first piston rotor is held stationary while said second piston rotor rotates to provide pumping action upon rotation of said drive shaft.

3. A rotary fluid pump comprising a dual action geneva cam in combination with a scissor-action rotary pump wherein said dual action geneva cam controls the position and movement of first and second piston rotors in said scissor-action rotary pump and includes:

(a) a driven member rigidly connected to a drive shaft, said driven member comprising two diametrically opposed driving pins, two diametrically opposed locking cams and two diametrically opposed relief sections, and (b) at least first and second driving members rigidly connected by offset drive means respectively to said first and said second piston rotors and rotatively disposed in adjacent quadrants about said driven member, each of said driving members comprising four cam-locking surfaces to engage and disengage said locking cams of said driven member and four slots to engage and disengage said driving pins of said driven member whereby alternatively said first piston rotor is held stationary while said second piston rotor rotates to provide pumping action upon rotation of said drive shaft.

4. A rotary internal combustion engine comprising a dual action geneva cam in combination with a scissor-action rotary internal combustion engine wherein said dual action geneva cam controls the position and movement of first and second piston rotors in said scissor-action rotary engine and includes:

(a) a driven member rigidly connected to a drive shaft, said driven member comprising diametrically opposed driving pins, diametrically opposed locking cams and diametrically opposed relief sections, and (b) driving members connected by offset drive means to said first and said second piston rotors and disposed about said driven member, each of said driving members comprising cam-locking surfaces to engage and disengage said locking cams of said driven member and slots to engage and disengage said driving pins of said driven member whereby alternatively said first piston rotor is held stationary while said second piston rotor rotates to provide four cycle operation upon ignition of a combustion chamber portion of said scissor-like rotary engine by ignition means.

5. A rotary internal combustion engine comprising a dual action geneva cam in combination with a scissor-action rotary internal combustion engine wherein said dual action geneva cam controls the position and movement of first and second piston rotors is said scissor-action rotary engine and includes:

(a) a driven member rigidly connected to a rotatable drive shaft, said driven member comprising two diametrically opposed driving pins, two diametrically opposed locking cams and two diametrically opposed relief sections, and (b) at least first and second driving members rigidly connected by offset drive means respectively to said first and said second piston rotors and rotatively disposed in adjacent quadrants about said driven member, each of said driving members comprising four cam-locking surfaces to engage and disengage said locking cams of said driven member and four slots to engage and disengage said driving pins of said driven member whereby alternatively said first piston rotor is held stationary while said second piston rotor rotates to provide four cycle operation upon ignition of a combustion chamber portion of said scissor-like rotary engine by ignition means.

6. A rotary fluid pump comprising:

a stationary pump block having an inner surface defining the outer portion of an annular chamber and having a pump block aperture coaxially disposed with the center of said annular chamber;

first and second piston rotors in side-by-side slidable relationship to each other, an outer surface of each of said piston rotors defining the inner portion of said annular chamber, wherein said first piston rotor is coaxially disposed with said pump block aperture by way of rigid attachment to a hollow cylinder shaft which passes therethrough, and said second piston rotor is coaxially disposed with said pump block aperture by way of rigid attachment to a solid cylinder shaft which passes through said hollow cylinder shaft;

at least two pairs of diametrically opposed pistons equally spaced and rigidly attached to each of said first and said second piston rotors, each of said pistons conforming to the shape of a section of said annular chamber and movable therein to form intake and exhaust chamber portions of said annular chamber as said first and said second piston rotors alternately rotate;

exhaust port means and intake port port means connected to said annular chamber and circumferentially spaced about said annular chamber;

a dual action geneva cam for controlling the position and movement of said first and said second piston rotors and for transferring rotative power to said piston rotors from a drive shaft including:

(a) a driven member rigidly connected to said drive shaft, said driven member comprising two diametrically opposed driving pins, two diametrically opposed locking cams and two diametrically opposed relief sections, and (b) at least first and second driving members rigidly connected by offset drive means respectively to said hollow cylinder shaft and said solid cylinder shaft and rotatively disposed in adjacent quadrants about said driven member, each of said driving members comprising four cam-locking surfaces to engage and disengage said locking cams of said driven member and four slots to engage and disengage said driving pins of said driven member whereby alternatively said first piston rotor is held stationary while said second piston rotor rotates about the center of said annular chamber to provide pumping action upon rotation of said drive shaft.

7. A rotary fluid pump as in claim 6 wherein said annular chamber is a torus cylinder and each of said pistons conforms to the shape of a portion of said torus cylinder.

8. A rotary fluid pump as in claim 6 wherein said dual action geneva cam further comprises third and fourth driving members rigidly connected by offset drive means respectively to said hollow cylinder shaft and said solid cylinder shaft, each of said third and fourth driving members being disposed within the two remaining quadrants about said driven member wherein said first and third driving members and said second and fourth driving members concertedly interact with said driven member.

9. A rotary fluid pump as in claim 6 wherein said offset drive means comprise (a) a long geneva shaft rigidly attached to said first driving member and to a first pinion gear, said first pinion gear engaging an outer cylinder central shaft gear rigidly connected to said hollow cylinder shaft and (b) a short geneva shaft rigidly attached to said second driving member and to a second pinion gear, said second pinion gear engaging an inner cylinder central shaft gear rigidly connected to said solid cylinder shaft.

10. A rotary internal combustion engine comprising:

a stationary engine block having an inner surface defining the outer portion of an annular chamber and having an engine block aperture coaxially disposed with the center of said annular chamber;

first and second piston rotors in side-by-side slidable relationship to each other, an outer surface of each of said piston rotors defining the inner portion of said annular chamber, wherein said first piston rotor is coaxially disposed with said engine block aperture by way of rigid attachment to a hollow cylinder shaft which passes therethrough, and said second piston rotor is coaxially disposed with said engine block aperture by way of rigid attachment to a solid cylinder shaft which passes through said hollow cylinder shaft;

at least two pairs of diametrically opposed pistons equally spaced and rigidly attached to each of said first and said second piston rotors, each of said pistons conforming to the shape of a section of said annular chamber and movable therein to form intake, compression, combustion, expansion, and exhaust chamber portions of said annular chamber as said first and said second piston rotors alternately rotate;

ignition means, exhaust port means, and intake port means for supplying a combustible mixture connected to said annular chamber and circumferentially spaced about said annular chamber; and a dual action geneva cam for controlling the position and movement of said first and said second piston rotors and for transferring rotative power to a drive shaft including:

(a) a driven member rigidly connected to said drive shaft, said driven member comprising two diametrically opposed driving pins, two diametrically opposed licking cams and two diametrically opposed relief sections, and (b) at least first and second driving members rigidly connected by offset drive means respectively to said hollow cylinder shaft and said solid cylinder shaft and rotatively disposed in adjacent quadrants about said driven member, each of said driving members comprising four cam-locking surfaces to engage and disengage said locking cams of said driven member and four slots to engage and disengage said driving pins of said driven member whereby alternatively said first piston rotor is held stationary while said second piston rotor rotates about the center of said annular chamber to provide four cycle operation upon ignition of said combustion chamber portion by said ignition means.

11. A rotary internal combustion engine as in claim 10 wherein said annular chamber is a torus cylinder and each of said pistons conforms to the shape of a portion of said torus cylinder.

12. A rotary internal combustion engine as in claim 10 wherein said dual action geneva cam further comprises third and fourth driving members rigidly connected by offset drive means respectively to said hollow cylinder shaft and said solid cylinder shaft, each of said third and fourth driving members being disposed within the two remaining quadrants about said driven member wherein said first and said third driving members and said second and said fourth driving members concertedly interact with said driven member.

13. A rotary internal combustion engine as in claim 10 wherein said offset drive means comprise (a) a long geneva shaft rigidly attached to said first driving member and to a first pinion gear, said first pinion gear engaging an outer cylinder central shaft gear rigidly connected to said hollow cylinder shaft and (b) a short geneva shaft rigidly attached to said second driving member and to a second pinion gear, said second pinion gear engaging an inner cylinder central shaft gear rigidly connected to said solid cylinder shaft.

* * * * *

UNITED STATES PATENT AND TRADEMARK OFFICE

CERTIFICATE OF CORRECTION

PATENT NO. : 4,679,535

DATED : July 14, 1987

INVENTOR(S) : Richard S. Stadden

It is certified that error appears in the above—identified patent and that said Letters Patent is hereby corrected as shown below:

In Col. 4, line 15, change "drove" to --drive--.

In Col. 4, line 65, change "emmbers" to --members--.

Signed and Sealed this

Twenty-fourth Day of November, 1987

*Attest:*

DONALD J. QUIGG

*Attesting Officer*

*Commissioner of Patents and Trademarks*